US007909661B2

(12) United States Patent
Wu

(10) Patent No.: US 7,909,661 B2
(45) Date of Patent: Mar. 22, 2011

(54) PLUG CONNECTOR WITH IMPROVED CABLE ARRANGEMENT AND HAVING RETAINING ARRANGEMENT SECURELY RETAINING MATING SUBSTRATE THEREIN

(75) Inventor: Jerry Wu, Irvine, CA (US)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 150 days.

(21) Appl. No.: 12/386,997

(22) Filed: Apr. 27, 2009

(65) Prior Publication Data

US 2010/0273335 A1 Oct. 28, 2010

(51) Int. Cl.
*H01R 13/502* (2006.01)

(52) U.S. Cl. ..... 439/701; 439/686; 439/357

(58) Field of Classification Search ..... 439/80, 439/76.1, 353, 354, 357, 358, 372, 694, 686, 439/701

See application file for complete search history.

(56) References Cited

U.S. PATENT DOCUMENTS 7,303,438 B2 12/2007 Dawiedczyk et al.
7,410,365 B2 8/2008 Wu

*Primary Examiner* — Tho D Ta
*Assistant Examiner* — Travis Chambers
(74) *Attorney, Agent, or Firm* — Wei Te Chung; Andrew C. Cheng; Ming Chieh Chang

(57) ABSTRACT

A plug connector, for mating with a complementary connector, includes a housing comprising a mating interface defined by a pair of tongue portions and an opening defined between the tongue sections, a cover assembled with housing, an inner mold received in the cover, a printed circuit boar received in the housing and the inner mold, a plurality of cables electrically attached to corresponding electrical pads of the printed circuit board, and a fastening element securely anchored to the housing. The cover includes a first section, a second section extending along a direction different from the first section extending along, and a bending section connecting the second section to the first section. The printed circuit board includes a plurality of electrical pads formed thereon a part of which defines a mating portion parallel to the pair of tongue sections. The fastening element includes column post extending through the printed circuit board.

19 Claims, 8 Drawing Sheets

PLUG CONNECTOR WITH IMPROVED CABLE ARRANGEMENT AND HAVING RETAINING ARRANGEMENT SECURELY RETAINING MATING SUBSTRATE THEREIN

This application is related to U.S. patent application Ser. No. 12/321,080 invented by Jerry Wu, both of which are currently assigned to the same assignee as this application.

BACKGROUND OF THE INVENTION

1. Field of the Invention

The present invention relates generally to a plug connector, and more particularly to a plug connector with circuit board connector mating substrate securely retained therein by means of a retaining pins extending therethrough.

2. Description of the Prior Art

Present electrical devices include so many internal components as to define complex internal spaces. Thus, internal connectors are needed to be adapting to the internal space.

U.S. Pat. No. 7,410,365, issued to Wu on Aug. 12, 2008, discloses a plug connector with improved engaging means that are assembled to the housing for locking board printed circuit board toward the housing reliable. However, the conventional housing extends along a horizontal direction is not adapted to some electrical devices.

Hence, in this art, a plug connector to overcome the above-mentioned disadvantages of the prior art should be provided.

BRIEF SUMMARY OF THE INVENTION

A primary object, therefore, of the present invention is to provide a plug connector with bending cover.

In order to implement the above object, the plug connector, mated with a complementary connector, comprises a housing comprising a mating interface defined by a pair of tongue portions and an opening defined between the tongue sections, a cover assembled with housing, an inner mold received in the cover, a printed circuit boar received in the housing and the inner mold, a plurality of cables electrically attached to corresponding electrical pads of the printed circuit board, and a fastening element securely anchored to the housing. The cover comprises a first section, a second section extending along a direction different from the first section extending along, and a bending section connecting the second section to the first section. The printed circuit board comprises a plurality of electrical pads formed thereon a part of which defines a mating portion parallel to the pair of tongue sections. The fastening element comprises at least one column post extending through the printed circuit board.

Other objects, advantages and novel features of the invention will become more apparent from the following detailed description of a preferred embodiment when taken in conjunction with the accompanying drawings.

DETAILED DESCRIPTION OF THE INVENTION

Reference will now be made in detail to a preferred embodiment of the present invention.

Figure 1:
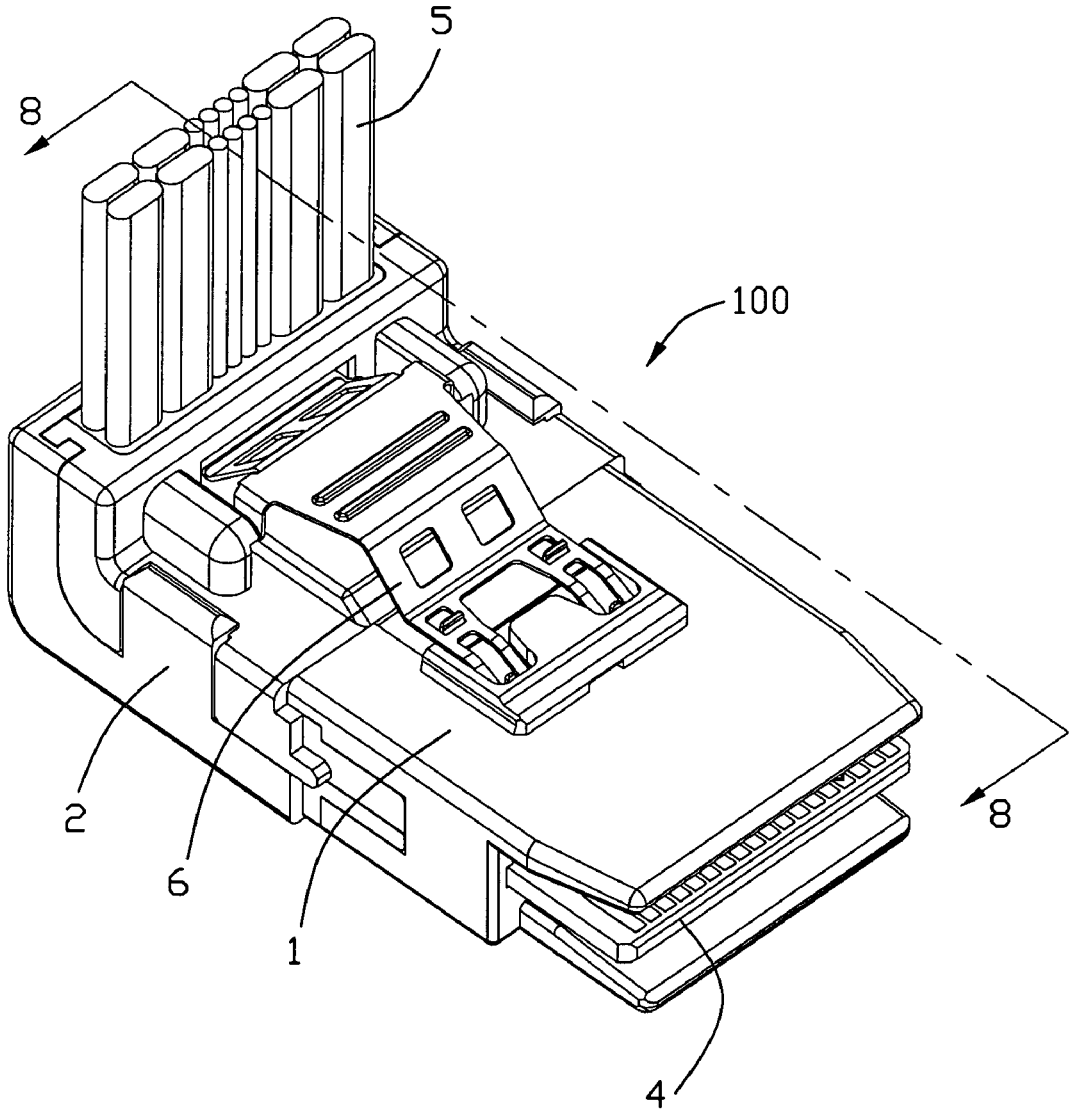
FIG. 1 is a perspective view of a plug connector in according with the present invention.
Figure 2:
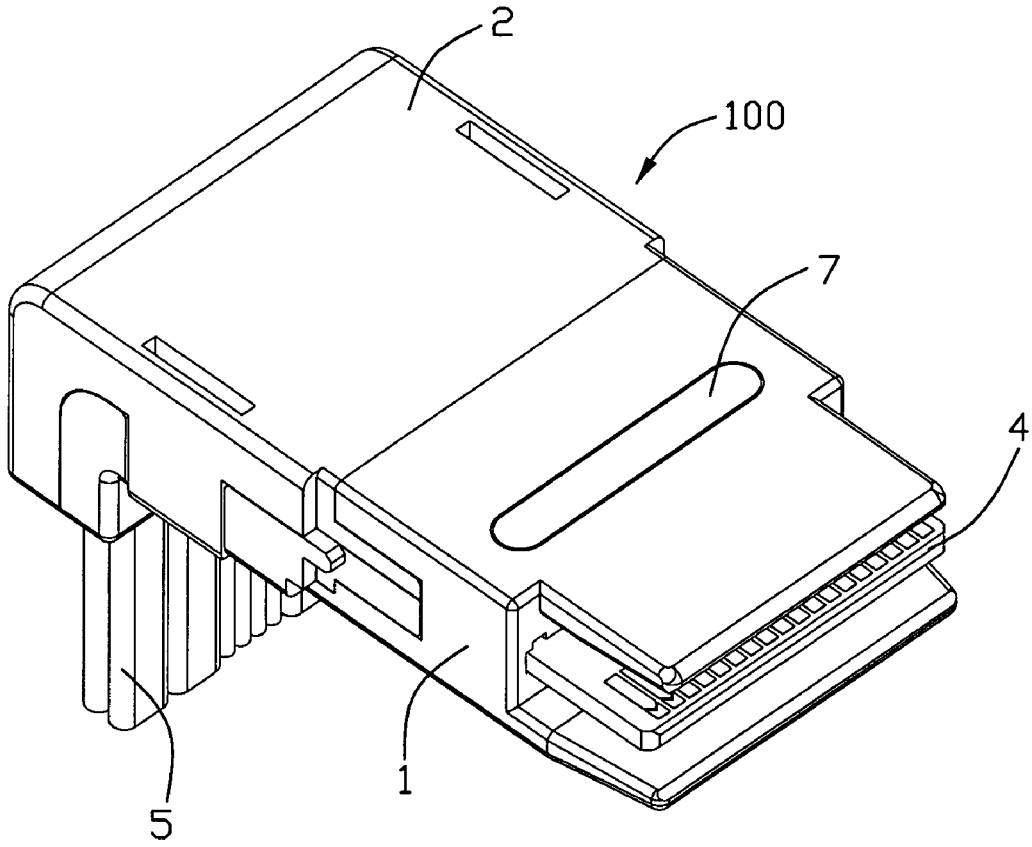
FIG. 2 is a view similar to FIG. 1, but taken from a different aspect.
Figure 3:
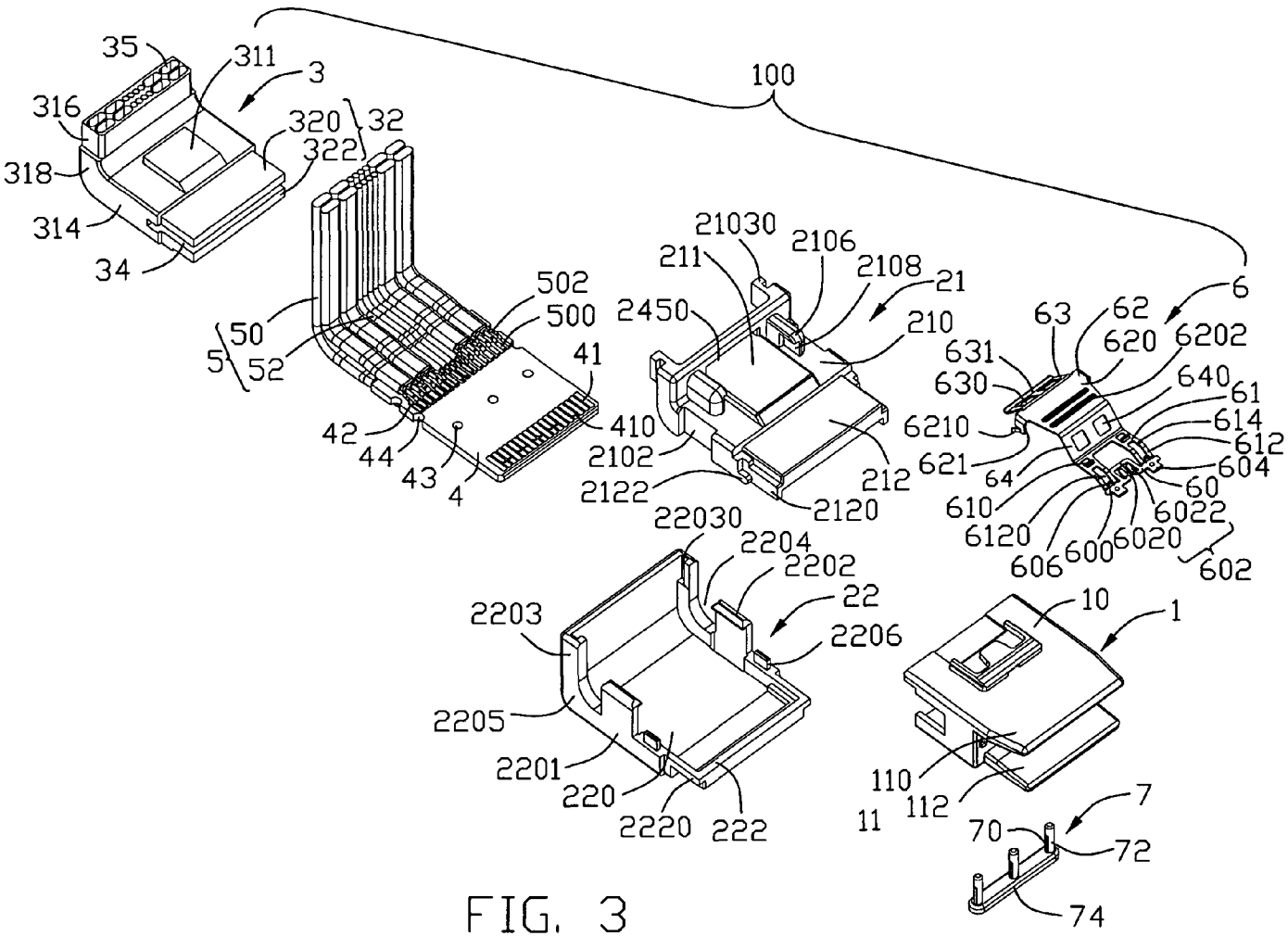
FIG. 3 is an exploded, perspective view of the plug connector in according with the present invention.
Figure 4:
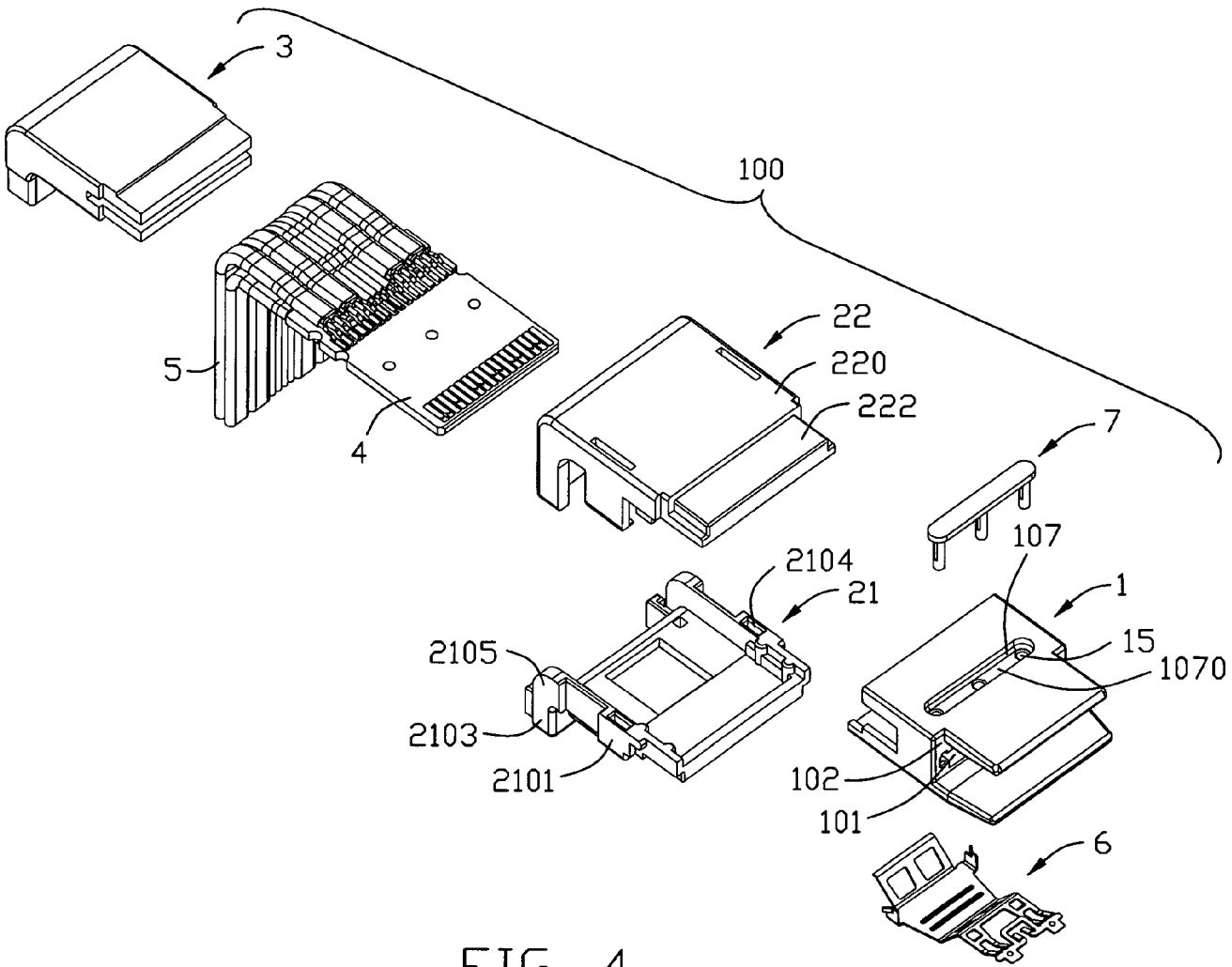
FIG. 4-5 are views similar to FIG. 3, but taken from different aspects.
Figure 5:
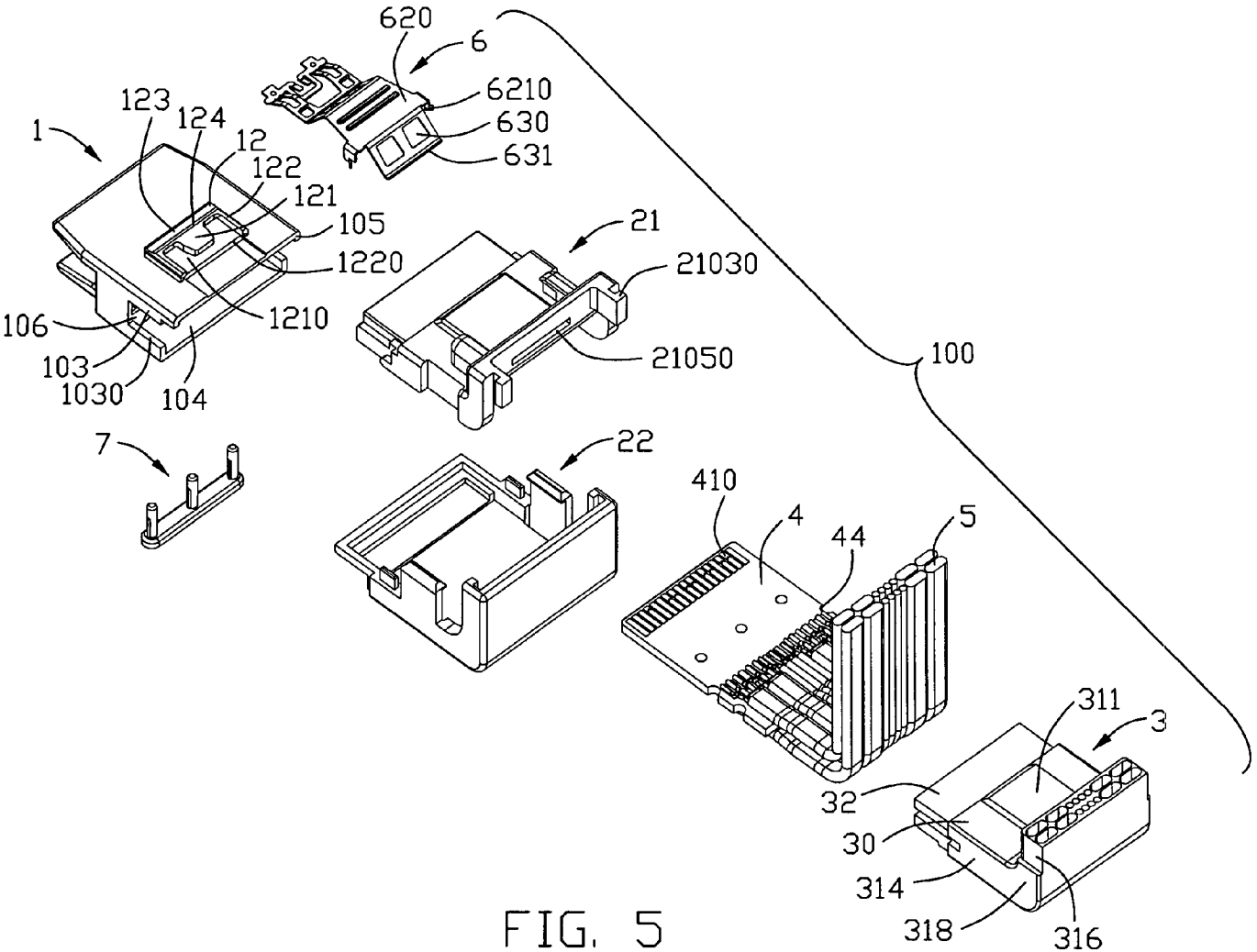

FIGS. 1 to 2 illustrate perspective views of an electrical plug connector 100 made in accordance with the present invention and used to exchange electrical signals and be connected to the complementary connector (not shown). The plug connector 100 comprises a housing 1, a cover 2 assembled to the housing 1, an inner mold 3 received in the cover 2, a printed circuit board (PCB) 4 with a part thereof received in the inner mold 3, a plurality of cables 5 connected to the PCB 4, a latch 6 assembled to the housing 1 and the cover 2 and a location pin 7 preventing the housing 1 from breaking off the connector 100.

Referring to FIGS. 3 to 8, the housing 1, which is made of insulative material with robust rigidity or other material, such as metal, comprises a rectangular body portion 10 defining a central receiving slot 101 therethrough, and a tongue portion 11 having first and second tongue sections 110, 112. The first and second tongue sections 110, 112 respectively extends forwardly from a front surface 101 of the body portion 10 and an opening (not labeled) formed between the first and second tongue sections 110, 112. The first and second tongue sections 110, 112 together with the opening form a mating interface (not labeled) of the housing 1.

The body portion 10 defines a rectangular receiving space 104 recessed forwardly from a rear surface thereof to communicate with the receiving slot 102, and thus, forming a pair of longitudinal walls 105, a pair of lateral walls 103, and an inner wall 106. Each lateral wall 103 defines a cutout 1030 to divide the lateral wall 103 to form an upper lateral arm and a lower lateral arm (not labeled). The receiving slot 102 recesses forwardly from the inner face to the front surface 101 of the body portion 10 and forms a pair of upper a lower surfaces opposite to each other and perpendicular to the inner wall 106. The outmost surface of the cutouts 1030 communicates with the corresponding lateral walls 103. A groove 107 recesses upwardly from the bottom surface of the body portion 10 to form a receiving space (not labeled) and a blocking surface 1070. Triple circular depressions holes 15 extend upwardly from the blocking surface 1070 to communicate with the receiving slot 102.

The body portion 10 forms an M-shape engaging portion 12 on a top surface and adjacent to the rear surface thereof. The engaging portion 12 comprises a protruding section 121 and a pair of arms 122 located at opposite sides of the protruding section 121, all extending rearward from a transverse main section 123. A slit 1210 is formed between the protruding section 121 and a top surface of the body portion 12 to extend into the main section 123 of the engaging portion 12. The top surface of the engaging portion 12 is higher than the top surface of the main section 123, and an inclined surface 124 is connected to the two top surfaces of the engaging portion 12 and the main section 123. A pair of trough 1220 is respectively formed in the arms 122 and open toward each other.

The inner mold 3 of the present invention is made of PVC material and in the form of L-shape configuration. In other alternative embodiments, the inner mold 3 can or also be made from other material, same as that of the housing 1 or different from that of the front housing piece 1. The inner mold 3 comprises a main portion 30 and a guiding portion 32. The main portion 30 comprises a horizontal and rectangular first portion 314, a vertical and rectangular second portion 316, and a bending portion 318 connecting the first portion 314 to the second portion 316. The second portion 316 is narrower than the first portion 314 and the bending portion 318. A flat extruding section 311 protrudes upwardly from the upper surface of the first portion and rearward extends form the front surface of the first portion 314 to be adjacent to but separated from the bending portion 318. A through slot 34 divides the guiding portion 32 into a first piece 320 and a second piece 322 separated from the first piece 320.

The cover 2 comprises a first upper cover 21 and a second lower cover 22 assembled with the first cover 21 together. The first cover 21 comprises a first main section 210 with a pair of side walls (not labeled) downwards extending from the two side edges of the first cover 21 for forming a receiving space (not labeled) therebetween and a first guiding section 212. The first main section 210 comprises a horizontal and rectangular first section 2101, a vertical and rectangular second section 2103, and a bending section 2105 connecting the first portion 2101 to the second portion 2103. The first section 210 comprises a pair of receiving groove 2102 on the outmost surfaces of the two side walls thereof and a pair of receiving holes 2104 respectively upward extending form the lower surfaces of the two side walls thereof. A transverse slot 21050 is formed on the front surface of the second section 2105 in communication with the upper surface of the main section 21. A flat extruding section 211, which is corresponding to the flat extruding portion 311 of the housing 3, protrudes upwardly from the upper surface of the first section 210 and rearward extends from the front surface of the first section 2101 into the slot 21050. A receiving space (not labeled) is defined between the upper surface of the slot 21050 and the flat extruding section 211. A pair of ear sections 2106 are located on opposite sides of the extruding section 211 and connected to the second section 2103. Each one of the ear sections 2106 has a recess 2108 backwardly recessed from the front surface thereof. The two recesses 2108 face to each other. The first guiding section 212 comprises a pair of first guiding projections 2120 on the two sides thereof and a pair of protrusions 2122 respectively frontward extending from the front surface of the first main section 210 on the outmost surfaces of the two first guiding projections 2120. The two first guiding projections 2120 are respectively across the two side surfaces of the main body 212 along front-to-rear direction. The outmost surface of each of the protrusions 2122 is coplanar with its corresponding side surface of the main portion 210. A pair of L-shaped inserting portion 21030 respectively extends from the rear surface of the side walls of the second section 2103 of the first main section 210.

The second cover 22 comprises a second main section 220 with two side walls (not labeled) for forming a receiving space (not labeled) between the two side walls and a second guiding section 222 frontward extending from the second main section 220. The second main section 220 comprises a horizontal first section 2201, a vertical second section 2203 separated from the first section 2201 and a second bending section 2205 connecting the first section 2201 to the second section 2203. A pair of fastening arms 2202, which corresponds to the pair of receiving grooves 2102, respectively upward extends from the two side walls of the first section and defines a channel 2204 between the side walls of the second section 2203 and the fastening arms 2202. Each of the two fastening arms 2202 comprises a clasp 22020 on the top thereof. A pair of rectangular posts 2206, which correspond to the two receiving holes 2104, extends from the two sides thereof on front of the fastening arm 2202. A pair of receiving channel 22030 respectively upward extends from the lower surfaces of the second section 2203 of the lower surface. The second guiding section 222 comprises a pair of second guiding projections 2220 on the two side thereof for correspond to the first guiding projections 2120.

The printed circuit board 4 has a plurality of first conductive traces 41 disposed along its leading edge which are intended to mate with the contacts (not shown) of the complementary connector when the plug connector 100 is inserted into the complementary connector, a plurality of second conductive traces 42 at middle thereof to be respectively connected to the cables 5, and triple holes 43 located between the first and second traces 41, 42 and arranged in a line. Each side edge of the printed circuit board 4 defines a pair of semicircular positioning holes 44 arranged along the front-back direction. In order to facilitate the so called hot-plug function, each of the first conductive traces 41 which are used for signal transmission are formed with a V-shape cutout 410 to let the first conductive traces 41 which are interconnected with ground contacts of the complementary connector firstly and disengaged from the complementary connector later. Such V-shape cut-outs 410 assure the signal transmission without being interrupted. Of course, the V-shape cutouts 410 also can be omitted here or have other configuration.

The cables 5 comprises two sets of sub-assemblies in a stacked relationship. Each set comprises four serial Attached Technology Attachment (ATA) standard cables 50 for high speed signal transmission and four strand wires 52 for low speed signal transmission. Of course, the strand wires 52 may not be included into the cable set in this embodiment or other embodiments according to different requirements. Each serial ATA standard cable 50 comprises a pair of signal conductors 500 respectively transmitting positive signal and negative signal, and a pair of grounding conductors 502 arranged at opposite outer sides of the pair of signal conductors 500 for providing grounding to the signal transmission.

The latch 6 is stamped and formed from a metallic sheet and comprises a retaining portion 60, a pair of locking portions 61 extending upwardly and backwardly from the retaining portion 60, a generally horizontal pressing portion 62 and an inclined supporting portion 63 slantwise extending from the pressing portion 62. The latch 6 further forms an inclined intermediate portion 64 connecting the pressing portion 62 with the locking portions 61.

The retaining portion 60 has a pair of transverse bar sections 600 respectively connecting with front edges of the locking portions 61, an engaging section 602 connecting with opposite inner ends of the pair of bar sections 600 and extending backwardly from the bar sections 600, and a pair of positioning sections 604 respectively extending forwardly from front edges of the pair of bar sections 600. Outmost end of each bar section 600 extends beyond outmost edge of corresponding locking portion 61 and served as guiding means for the latch 6. The engaging section 602 is located between the pair of locking portion 61 and comprises a rectangular frame 6020 located in a horizontal surface and a pair of elastic snapping section 6022 extending into the space circumscribed by the frame 6020 with distal ends bending upwardly. Each locking portion 61 comprises an inclined first section 612 extending rearward and upwardly from the retaining portion 60 and a flat second section 614 extending rearward from the first section 612 to connect with the intermediate portion 64. Each inclined first section defines a cutout 6120 therein for increasing flexibility thereof. Each cutout 6120 extends form the first section 612 to the second section 614. The second section 614 is formed with a pair of latch sections 610 extending upwardly and rearward form a front portion thereof. A pair of stop sections 606 are respectively formed with the bar sections 600 and extending into the cutout 6120 and curve upwardly. The pressing portion 62 comprises a body section 620 and a pair of side beams 621 extending downwardly from opposite lateral ends of the body section 620. Each side beam 621 is formed with a spring tab 6210 extending outwardly therefrom. The body section 620 is formed with a plurality of rims 6202 for easy handling. The supporting portion 63 defines a pair of rectangular openings 630 and forms a curved edge 631 at a free end thereof. The intermediate portion 64 defines a pair of elongated cutouts 640.

In assembly of the plug connector 100, the two sets of cables 5 are respectively soldered to the second conductive pads 42 located on the upper and lower surfaces of the printed circuit board 4, and then are bend at a proper position. The inner mold 3 is then molded over the printed circuit board 4 and the cables 5 to form a plurality of different-size receiving passages 35. The rear portion of the printed circuit board 4 is received in the through slot 34 formed in the guiding portion 32, and the cables 5 respectively protruding through the corresponding receiving passages 35 to expose out of a rear surface of the inner mold 3. The pair of positioning holes 44 located at a relatively rear position are filled with the same material as the inner mold 3 for securely fastening together the inner mold 3 with the printed circuit board 3. Of course, the inner mold 3 can be molded firstly, and then is pushed forwardly toward the cables 5 and the printed circuit board 4 to enclose the junctions between the cables 5 and the printed circuit board 4.

Figure 6:
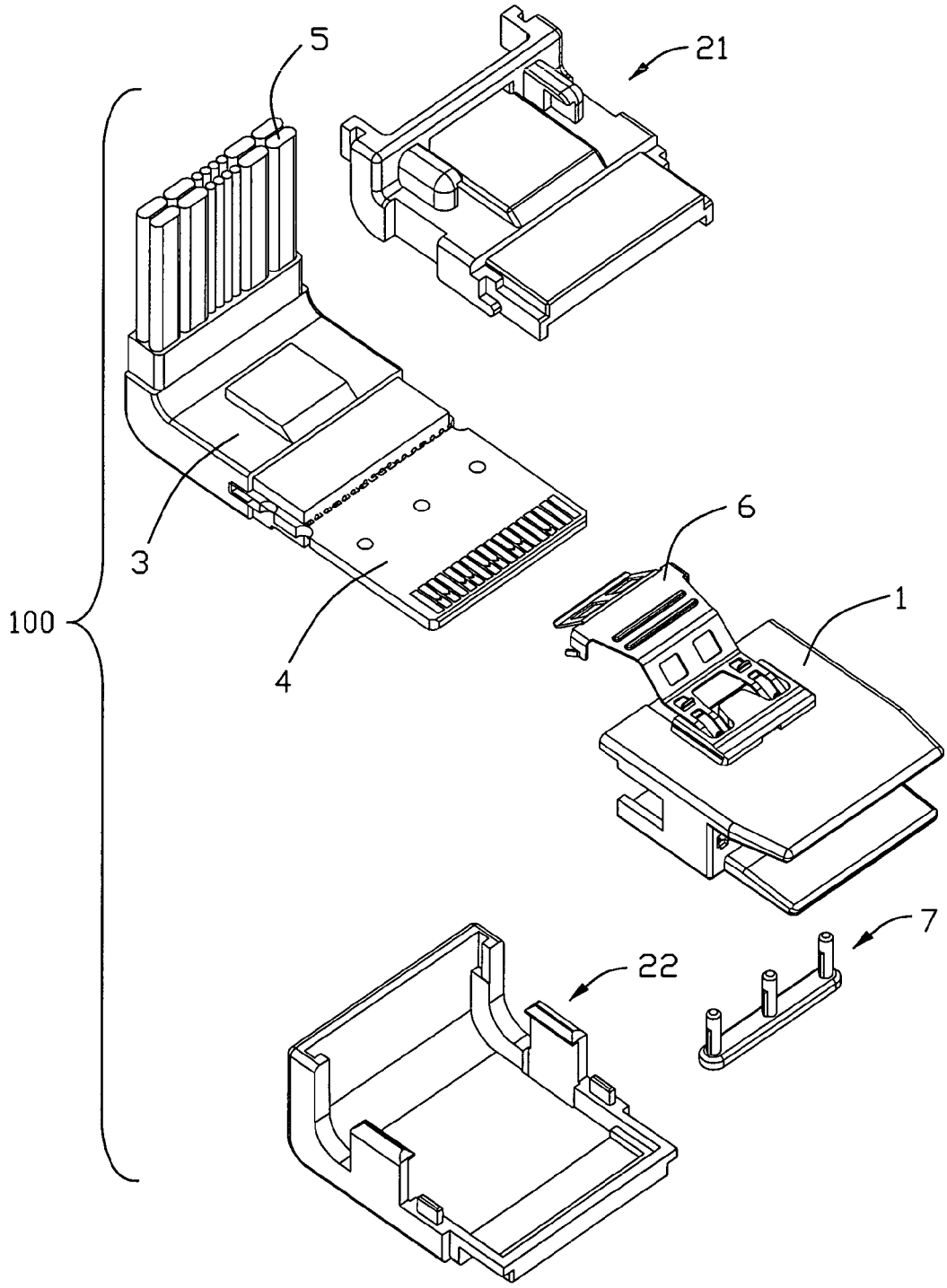
FIG. 6-7 are part-assembled views of the plug connector of the present invention.

Referencing to FIG. 6, the inner mold 3 with the cables 4 and the printed circuit board 3 is covered by the first cover 21 and the second cover 22. The first cover 21 and the second cover 22 are respectively assembled on the inner mold 3 for receiving the inner mold 3 with the cables 4 and the printed circuit board 3 in its receiving space. As the first cover 21 and the second cover 22 are assembled on the inner mold 3, the two fastening arms 2202 of the second cover 22 respectively go through the corresponding receiving grooves 2102 of the first cover 21 with the two clasps 22020 of the fastening arms 2202 catching the first cover 21 for securely assembling the first cover 21 with the second cover 22, the two posts 2206 of the second cover 22 are respectively inserted into the receiving holes 2104, and the two inserting portions 21030 are respectively received in the corresponding receiving channel 22030. Each of the side walls of the first cover 21 is connected to its corresponding side wall of the second cover 22.

Figure 7:
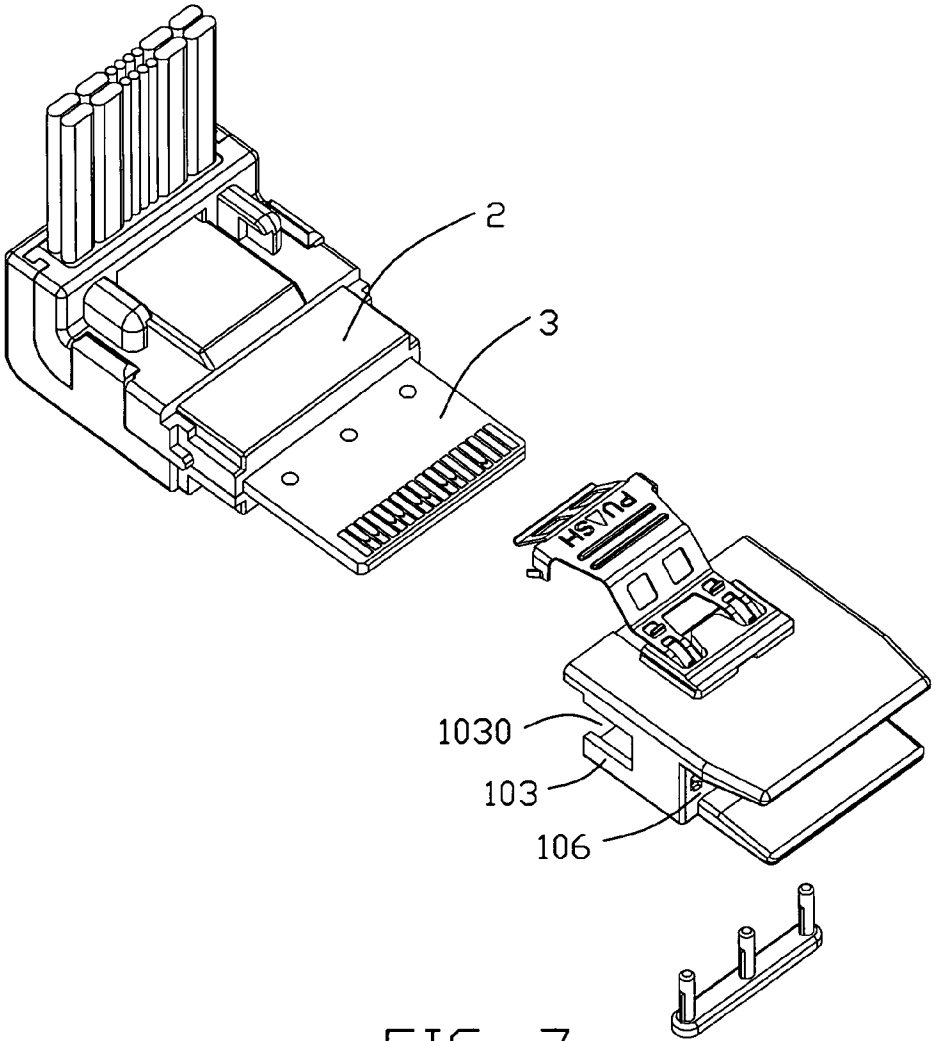

Referencing to FIG. 7, with the guidance of the pair of guiding projections assembled by the first and second guiding projections 2120, 2220 sliding into the cutouts 1030 of the lateral walls 103, the front portion of the printed circuit board 4 protrudes through the receiving slot 102 to be exposed between the first and second tongue sections 110, 112 until a front surface of the cover 2 abuts against the front inner wall 106 of the housing 1. Thus, the through holes 43 of the printed circuit board 4 align with the circular depression 15. To enhance the combination of the printed circuit board 4 and the housing 1, the fastening portion 7 are employed. The fastening portion 7 comprises a connecting board 74 and three column posts 72 respectively attached on the connecting board 74. Each column post 72 has a rim 70 on one side thereof. The three column posts 72 respectively extend through the circular depressions 15 and the three holes 43 into receiving space of the front housing 11 with the rims 70 respectively compressing on the inner surface of the circular depressions 15 and the connecting board 74 received in the circular depression 15. Via the fastening portion 7, the printed circuit board 4 is securely assembled with the front housing piece 1 and has no possibility of being pulled out from the front housing piece 1 when user is pulling the cables 5, further enhancing the engagement between the front and inner molds 1, 2. The fastening portion 7 and the three through holes 43 serve as engaging means to position the printed circuit board 4 to the housing 1. Accordingly, the front portion of the printed circuit board 4 is wholly received in the housing 1 and the front ends of the cables 5 are fully covered by the inner housing 1 and the cover 2 for achieving a reliable connection with the printed circuit board 4.

Figure 8:
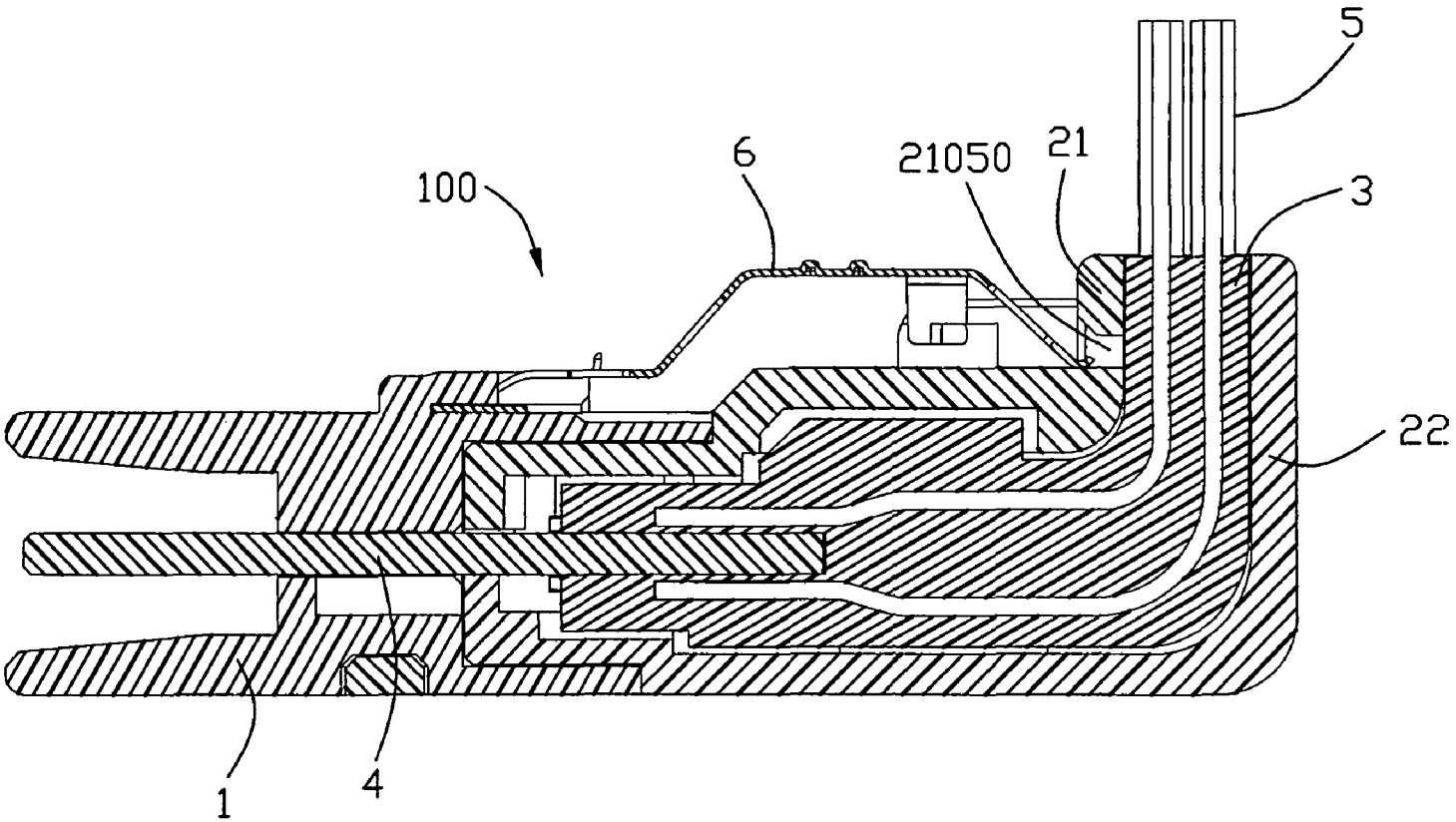
FIG. 8 is cross-section views of the plug connector taken along lines 8-8 of FIG. 1.

Particularly referring to FIGS. 1 and 7 in conjunction with FIGS. 8 and 9, the latch 6 is assembled on the housing 1 and first cover 21. A forward pressing force is exerted on the latch 6. The spring tabs 6210 of the pressing portion 62 respectively slide along the recesses 2108 of the ear sections 2106 of the first cover 21. At the same time, with the guidance of the outmost ends of the retaining portion 60 sliding along the grooves 1220 of the arms 122 of the housing 1, the bar section 600 and the engaging section 602 are received in the slit 1210 with the positioning sections 604 and the snapping sections 6022 respectively locked into the slots 1230 to prevent the latch 6 from moving rearward when the plug connector 100 mates with the complementary connector. The pair of stop sections 606 is located in front of the main section 123 for preventing excessive forward movement of the latch 6. The supporting portion 63 is located above the extruding section 211 of the first cover 21 with the curved edge 631 abutting against a surface of the extruding section 211 and extending into the transverse slot 21050 of the second section 216. The spring tabs 6210 of the pressing portion 62 elastically engage with inner surfaces of the recesses 2108 of the ear sections 2106 for preventing the latch 6 from escaping the recesses 2108 of the first cover 21. The pressing portion 62 is downwardly movable relative to the rear portion of the first cover 21 to deflect the locking portion 61 toward the housing 1 and the first cover 21.

The complementary connector has corresponding structure locking with the pair of latch sections 610 of the latch 6 to realize the reliable engagement with the plug connector 100. When the plug connector 100 is to be disconnected from the complementary connector, a downward pressing force is exerted on the pressing portion 62 of the latch 6. The pressing portion 62 moves downwardly and the locking portion 61 creates a vertical displacement toward the housing 1. The retaining portion 60 is engaged with the housing 1 and the supporting portion 63 extends into the transverse slot 2108 to press on the first cover 21, thus, together form a girder. The vertical displacement of the locking portion 61, particularly the latch sections 610, is big spatially enough to realize the disconnection between the plug connector 100 and the complementary connector easily.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A plug connector for mating with a complementary connector, comprising:

a housing comprising a mating interface defined by a pair of tongue sections and an opening defined between the tongue sections;

a cover assembled with the housing and comprising a first section, a second section extending along a direction different from an extending direction of the first section, and a bending section connecting the second section to the first section;

an inner mold received in the cover;

a printed circuit board, received in the housing and the inner mold, the printed circuit board having a plurality of electrical pads formed thereon, a part of said electrical pads defining a mating portion parallel to the pair of tongue sections;

a plurality of cables electrically attached to corresponding electrical pads of the printed circuit board; and a fastening element securely anchored to the housing and having at least one column post extending through the printed circuit board.

2. The plug connector as claimed in claim 1, wherein the printed circuit board defines a rear portion, together with the cables, molded by the inner mold and a front portion exposed out of the inner mold, and the inner mold comprises a first portion, a second portion extending along a direction different from the first portion and a bending portion connecting the second portion to the first portion.

3. The plug connector as claimed in claim 1, wherein the fastening element comprises a connecting portion received in the housing.

4. The plug connector as claimed in claim 1, wherein the cover comprises a first cover having a first main section and a first guiding section extending from the first main section and a second cover having a second main section and a second guiding section extending from the second main section.

5. The plug connector as claimed in claim 4, wherein each of the first cover and the second cover comprises a main section with a pair of side walls to define a receiving space therebetween.

6. The plug connector as claimed in claim 5, wherein the guiding section of the first cover comprises a pair of guiding projections on two sides thereof and a pair of protrusions respectively on the two opposite sides of the two guiding projections.

7. The plug connector as claimed in claim 5, wherein the guiding section of the second cover comprises a pair of second guiding projections on two side thereof.

8. The plug connector as claimed in claim 5, wherein the main section of the first cover comprises a horizontal first section, a vertical second section, a bending section connecting the second section to the first section.

9. The plug connector as claimed in claim 8, wherein the main section of the first cover further comprises a pair of receiving grooves on a outmost surface thereof, a receiving slot formed on the front surface of the second section in communication with the upper surface of the first section, and a flat extruding section protruding from the upper surface of the first section and across the first section along a front-to-rear direction.

10. The plug connector as claimed in claim 9, wherein the main section of the first cover further comprises a pair of inserting portions respectively extending from the rear surface of the side walls of the second section.

11. The plug connector as claimed in claim 5, wherein the main section of the second cover comprises a horizontal first section, a vertical second section and a bending section connecting the second section to the first section.

12. The plug connector as claimed in claim 11, wherein the main section of the second cover further comprises a pair of fastening arms extending from the two side walls of the first section and defining a channel between the side walls of the second section and the fastening arms, a pair of posts extending from two sides thereof and separated from the fastening arms, and a pair of receiving channels respectively formed on the two side walls of the second section.

13. The plug connector as claimed in claim 4, further comprising a latch made from metallic material and comprising a retaining portion, a pair of locking portions extending upwardly and backwardly from the retaining portion, a generally horizontal pressing portion and an inclined supporting portion slantwise extending from the pressing portion.

14. The plug connector as claimed in claim 13, wherein the supporting portion has a curved edge at a free end thereof extending into a transverse slot of the first cover.

15. An electrical cable connector comprising:

an insulative housing defining a pair of parallel mating tongues;

a printed circuit board located between said pair of mating tongues in a parallel relation, and defining a front mating region and a rear connection region;

a plurality of cables connected to the rear connection region and defining an angled elbow potion;

an insulative right angle inner mold enclosing said elbow portion;

an insulative right angle top cover and an insulative right angle bottom cover cooperating with each other to compliantly sandwich said inner mold therebetween; and an up-and-down moveable metallic resilient latch having a front end protectively fastened to the housing and a rear end moveably and protectively received in a transverse slot in the bottom cover.

16. The electrical cable connector as claimed in claim 15, wherein one of the top cover and the bottom cover includes a fastening arm to lock to the other.

17. The electrical cable connector as claimed in claim 15, wherein said bottom cover further defines a pair of ear sections each with a recess forwardly communicating with an exterior for achieving easy manufacturability during injection molding the bottom cover, under condition that said latch includes a pair of side beams each defining a tab to be moveably received in the corresponding recess.

18. An electrical cable connector comprising:

an insulative housing defining a pair of parallel mating tongues;

a printed circuit board located between said pair of mating tongues in a parallel relation, and defining a front mating region and a rear connection region;

a plurality of cables connected to the rear connection region and defining an angled elbow potion;

an insulative right angle inner mold enclosing said elbow portion;

an insulative right angle top cover and an insulative right angle bottom cover cooperating with each other to compliantly sandwich said inner mold therebetween, said bottom cover further defines a pair of ear sections each with a recess forwardly communicating with an exterior for achieving easy manufacturability during injection molding the bottom cover; and an up-and-down moveable metallic resilient latch having a front end protectively fastened to the housing and a pair of side beams each with a tab protectively received in the corresponding recess.

19. The cable connector assembly as claimed in claim 18, wherein said ear section defines an downwardly lying L-shaped configuration so as to restrain the corresponding tab from an upward direction, a downward direction, a rearward direction and an outward direction.

* * * * *